US006375182B1

(12) United States Patent
Sting et al.

(10) Patent No.: US 6,375,182 B1
(45) Date of Patent: Apr. 23, 2002

(54) FEEDING MACHINE

(75) Inventors: Martin Sting, Frankfurt; Stephan Will, Biehertal, both of (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 0 days.

(21) Appl. No.: 09/485,429

(22) PCT Filed: Aug. 12, 1998

(86) PCT No.: PCT/EP98/05131

§ 371 Date: May 8, 2000

§ 102(e) Date: May 8, 2000

(87) PCT Pub. No.: WO99/08951

PCT Pub. Date: Feb. 25, 1999

(30) Foreign Application Priority Data

Aug. 14, 1997 (DE) ..... 197 35 382

(51) Int. Cl.[7] ..... B65H 5/00

(52) U.S. Cl. ..... 271/10.03; 271/10.06; 271/10.07; 271/35; 271/151; 271/277; 271/265.02

(58) Field of Search ..... 271/151, 10.06, 271/10.07, 7, 35, 10.02, 10.03, 10.05, 265.01, 265.02, 275, 273

(56) References Cited

U.S. PATENT DOCUMENTS 3,664,660 A * 5/1972 Runzi ..... 271/35
3,780,881 A * 12/1973 Friel
4,240,539 A 12/1980 Harmut ..... 198/461
4,366,955 A 1/1983 Pessina et al. ..... 271/7
4,673,175 A * 6/1987 Morita ..... 271/10.03
4,809,964 A * 3/1989 Wood ..... 271/151
4,832,179 A 5/1989 Simmons ..... 198/461
4,930,764 A 6/1990 Holbrook et al. ..... 271/119
4,973,037 A 11/1990 Holbrook ..... 271/2
4,978,114 A 12/1990 Holbrook ..... 271/35
5,131,899 A 7/1992 Nagahashi et al. ..... 493/317
5,154,408 A 10/1992 Stepan et al. ..... 271/121
5,161,792 A * 11/1992 Wood
5,192,069 A * 3/1993 Seymour et al. ..... 271/35
5,211,529 A 5/1993 Esala et al. ..... 414/795.8
5,249,788 A * 10/1993 Helmstadter ..... 271/10.07
5,308,052 A 5/1994 Roch et al. ..... 271/2
5,413,323 A 5/1995 Imbert et al. ..... 271/149
5,508,818 A 4/1996 Hamma ..... 358/403
5,601,282 A * 2/1997 Milo et al. ..... 271/35
5,775,871 A 7/1998 Redden ..... 414/795.9
5,971,389 A 10/1999 Golicz et al. ..... 271/34

* cited by examiner

*Primary Examiner*—H. Grant Skaggs
(74) *Attorney, Agent, or Firm*—Michael J. Cummings; Angelo N. Chaclas

(57) ABSTRACT

A feeding machine for feeding envelopes into a station for further individual handling. A stack of envelopes is held in a downwardly inclined feed channel. The stack of envelopes is transformed into a layered stream by an upward inclined discharge channel including a conveyor unit that carries a stream of envelopes through a gap formed by an imbricator strip and a low friction circulation belt. The layered stream is conveyed to a removal point where a removal device removes individual envelopes for further processing. The conveyance of the layered stream is controlled in such a manner that the removal device can remove individual envelopes at regular time intervals.

12 Claims, 3 Drawing Sheets

FEEDING MACHINE

TECHNICAL FIELD

The invention relates to a feeding machine for feeding flat, flexible conveyed items which are input in stacks, in particular envelopes, into a station for further individual handling.

BACKGROUND ART

Feeding machines in which the conveyed items are input, as stacks of conveyed items, into magazines from which the conveyed items are pulled out individually, for example by means of suction rolls or grippers, and transferred into a station for further individual handling are generally known.

In modern mail-processing machines which operate at very high clock speeds it is necessary for the magazines of the feeding machines to be frequently filled manually with stacks of conveyed items because the stacks in the magazines are not supposed to exceed a specific height in order to keep the pressure caused by the weight of the stack at its lower end within such limits that the devices for pulling off the individual conveyed items can operate reliably there.

The problem of frequent refilling of stacks of conveyed items into magazines of known feeding machines has already been countered by placing before said devices an automatic feeding unit which, as a function of a signal which reports lowering of the stack located in the magazine below a certain level, fed conveyed items out of an elongated stack of upright conveyed items which is conveyed forwards approximately horizontally in a feed channel, by means of obliquely upwardly feeding conveyor belts which have a high degree of friction with respect to the conveyed items, initially upwards and then past an imbricator strip to the magazine in an approximately horizontal direction, without however in the process separating the conveyed items. The feeding of the automatic feeding unit which is placed upstream was continued until a further detector signalled a sufficient degree of filling of the magazine.

DISCLOSURE OF THE INVENTION

The object of the present invention is to design a feeding machine for feeding flat, flexible conveyed items which are input in stacks, in particular envelopes, into a station for further individual handling in such a way that the number of conveyed items which are input in stacks does not have to be severely limited, and intermediate storage of the conveyed items in a magazine is avoided.

This object is achieved according to the invention by means of the features of the appended Patent Claim 1. Advantageous refinements and developments are the subject-matter of the patent claims subordinate to Patent Claim 1, to whose content reference is made here expressly without repeating the wording of which at this point.

BRIEF DESCRIPTION OF THE DRAWINGS

Exemplary embodiments are described below with reference to the drawing, in which.

DETAILED DESCRIPTION OF THE INVENTION

Figure 1:
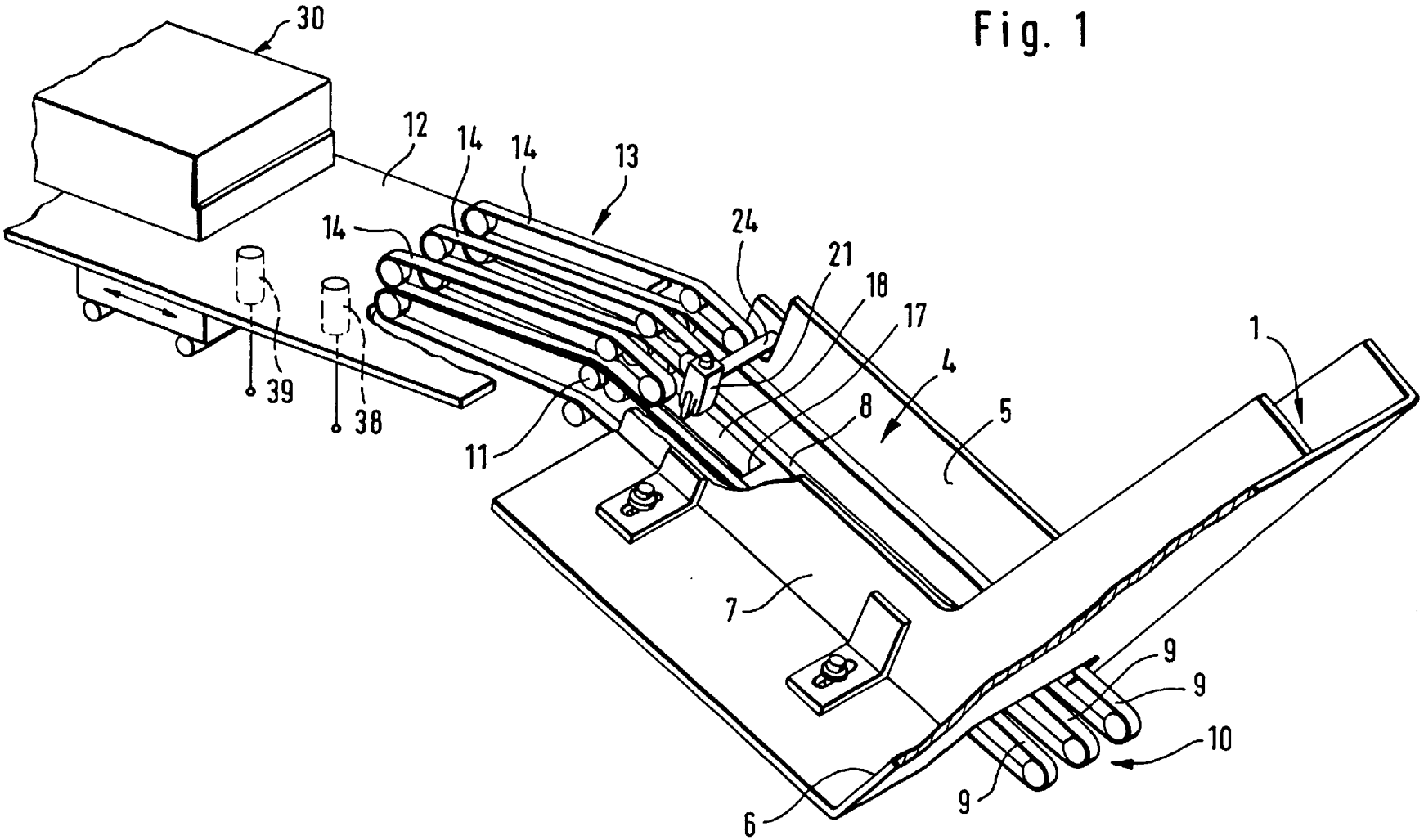
FIG. 1 shows a schematic, perspective view of a feeding machine of the type specified here.
Figure 2:
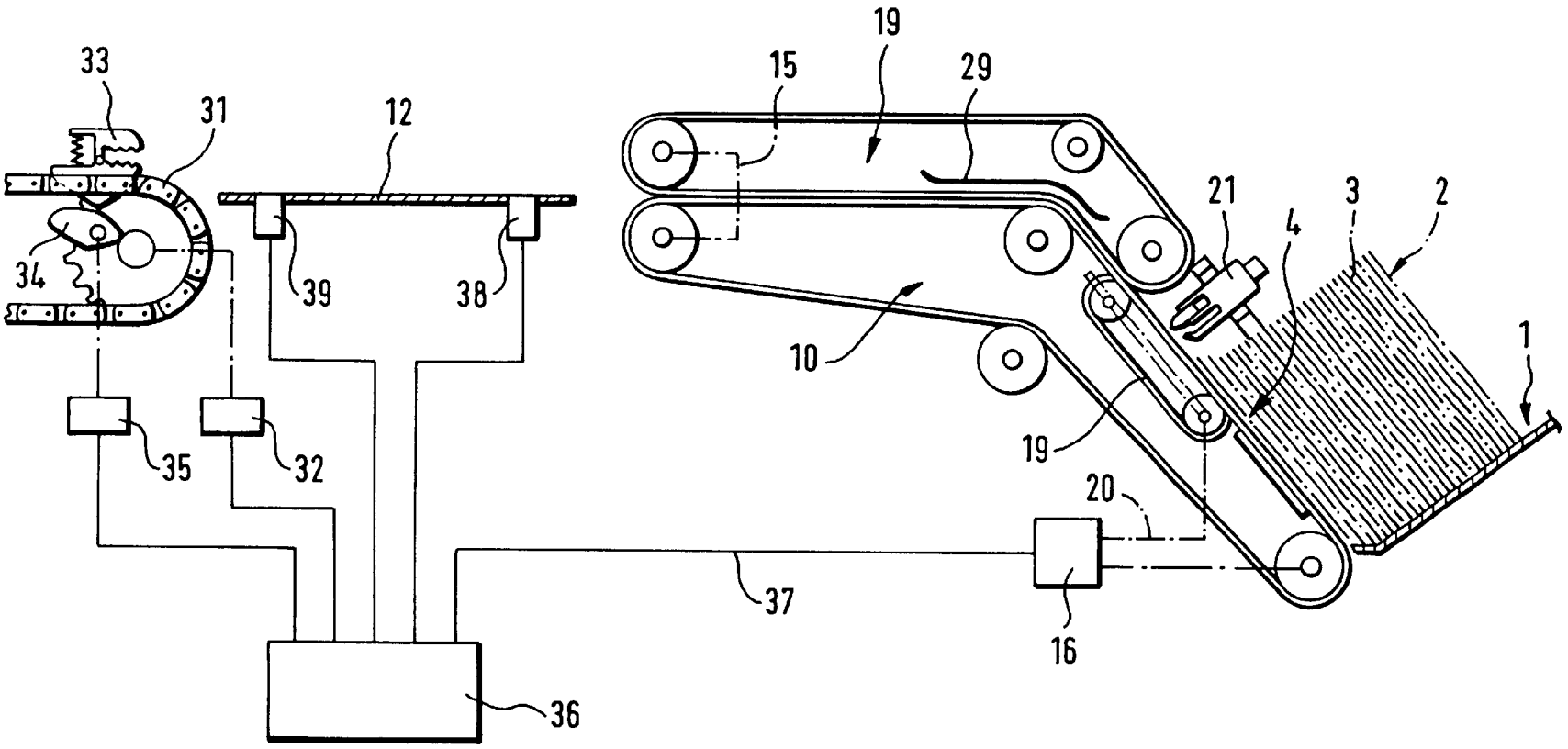
FIG. 2 shows a schematic side view of the feeding machine according to FIG. 1, with details of a part of the station for further individual handling of the conveyed items being indicated.

The feeding machine of the type proposed here contains, as is clear from FIG. 1, an obliquely downwardly extending feed channel 1 for holding stacks 2 of conveyed items 3, which stacks are placed in the feed channel 1 in the way which is shown in FIG. 2.

A discharge channel 4 leads obliquely upwards from the lower end of the feed channel 1. The negative gradient of the feed channel 1 is selected to be sufficiently large to allow large stacks of conveyed items which are contained in it to slip downwards in the direction of the discharge channel 4, but at the same time sufficiently small to limit the pressure of the stack on the bottom most item to be conveyed.

The feed channel 1 and the discharge channel 4 have a common, viewed in the conveying direction, right-hand angular side wall 5, a common angular base 6 and a common, viewed in the conveying direction, left-hand angular side wall 7. The side wall 7 can be adjusted to specific formats of the conveyed items, in the direction transverse to the conveying direction in the manner shown in FIG. 1 by means of angular elements which are attached to said side wall 7 and are provided with elongated holes on the free limb.

The base 6 of the feed channel 1 and of the discharge channel 4 is cut out at the junction between the two channels in the way which can be seen in FIG. 1, in such a way that the upper strands 8 of three conveyor belts 9 of a first conveyor belt unit 10 can be guided over the base of the discharge channel 4. The upper strands of the conveyor belts 9 therefore follow the profile of the discharge channel 4 obliquely downwards and then merge at its upper end, supported by deflection rollers 11, with a horizontal profile parallel to the plane of a transfer table 12. The transfer table 12 is provided with longitudinal slots from which the upper strands for the conveyor belts 9 protrude, in their horizontally extending section, somewhat above the level of the table.

The lower strands of the conveyor belts 9 are led back over suitably positioned rollers underneath the transport table 12 and underneath the base of the discharge channel 4 to the start of the conveyor belt near to the junction between the feed channel and the discharge channel.

Above the upper strands 8 of the conveyor belts 9 of the first conveyor belt unit 10 a second conveyor belt unit 13 whose lower strands lie opposite the upper strands of the first conveyor belt unit from a region before the change of direction of the upper strands 8 to the horizontal profile as far as a region above the first conveyor belt unit 10 in the horizontal section. This profile of the conveyor belts 14 of the second conveyor belt unit 13 can be seen readily in FIGS. 1 and 2. As is indicated symbolically by the dot-dashed line 15 in FIG. 2, the conveyor belts 9 of the first conveyor belt unit 10, and the conveyor belts 14 of the second conveyor belt unit 13 circulate synchronously. They are made to rotate by a drive device which is indicated by 16 in FIG. 2.

The base of the discharge channel 4 is provided with a portion 17 which is oriented in the conveying direction, in a region between two conveyor belts 9 of the first conveyor belt unit 10, the upper strand 18 of a circulating belt 19 (see FIG. 2) protruding out of said portion 17 somewhat above the level of the base of the discharge channel 4, the surface of which belt 19 is low in friction. The circulating belt 19 is, as is indicated symbolically in FIG. 2 by the dot-dashed line 20, driven in synchronism with and in the same direction as the conveyor belts 9 of the first conveyor belt unit 10.

Figure 3:
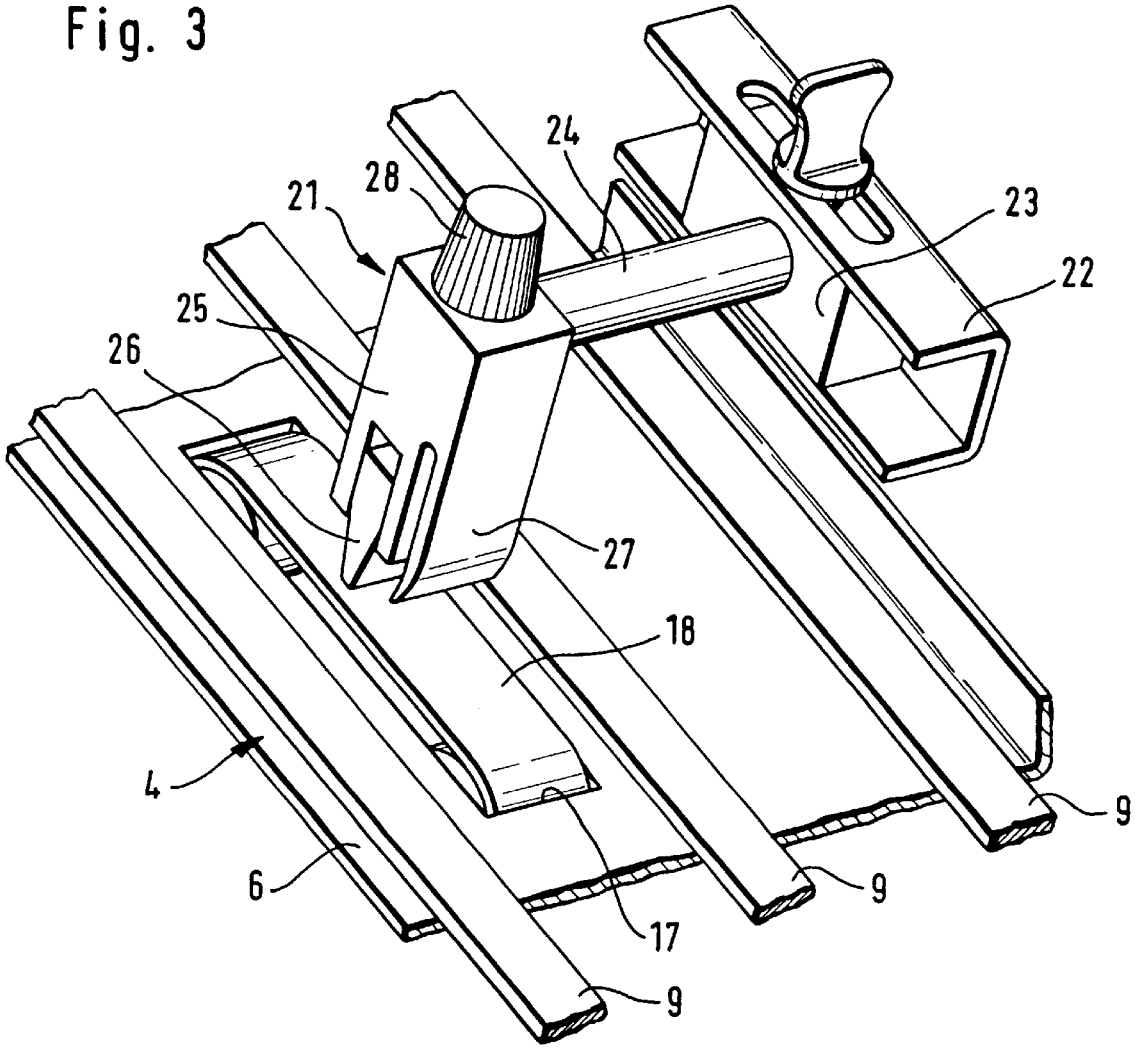
FIG. 3 shows a perspective view of a detail of the feeding machine according to FIG. 1 in which an imbricator strip is active.

An imbricator strip 21 interacts with the smooth surface of the circulating belt 19 as opposite surface, the design of said imbricator strip being shown in detail in FIG. 3. Arranged fixed to the frame to the side of the discharge channel 4 is a guide rail 22 in which a carriage 23 is adjustably held in a direction parallel to the conveying direction of the discharge channel 4. The carriage 23 bears by means of an arm 24 an imbricator strip block 25 which holds in its lower part an approximately wedge-shaped imbricator strip 26 made of rubber or plastic. The imbricator strip 26 has a front strip 27 mounted before it. The distance between the lower edge of the imbricator strip 26 and the surface of the upper strand 18 of the circulating belt 19 can be adjusted by means of an adjustment knob 28. By adjusting the carriage 23 in the direction of the guide rail 22 it is possible to set the position of the setting block 25 of the imbricator strip 21 in order to allow for the dimensions of the conveyed items in the conveying direction along the upper strand 18 of the circulating belt 19.

If a stack 2 of conveyed items 3 conveyed is inserted into the feed channel 1 in the way shown in FIG. 2, the conveyed items which are at the bottom are conveyed upwards by the upper strands 8 of the conveyor belts 9 of the conveyor belt unit 10 along the discharge channel 4, conveyed items 3 which are located higher up being held back by the front strip 7, and ultimately the imbricator strip 6 initially allowing only the front part of an individual conveyed item to follow the movement of the conveyor belts 9 owing to the set distance from the surface of the upper strand 18 of the circulating belt 19, with the result that this part of the conveyed item which is conveyed on passes between the lower strands of the conveyor belts 14 of the conveyor belt unit 13 and the upper strands of the conveyor belts 9 of the conveyor belt unit 10 and is reliably conveyed on. A deflection plate 29 which extends over the entire width of the conveyor belt units, and is indicated in FIG. 2, prevents corners or clips or the like which project laterally from the items to be conveyed from running up against parts of the system and leading to incorrect conveying.

The imbricator strip 21 which interacts with the upper strand 18 of the circulating belt 19 as an opposite face, and the upper strands 18 of the conveyor belts 9, thus have the effect that an imbricated or separated stream of conveyed items 3 runs in between the conveyor belt units 10 and 13, the imbrication distance or separation distance of which is set up at the imbricator strip 21. This imbricated or separated stream of conveyed items 3 emerges onto the transfer table 12 on the delivery side between the conveyor belt units 10 and 13, which transfer table 12 leads onto a removal device 30 which is positioned at a certain distance from the delivery side of the first and second conveyor belt units and serves to grasp the front edge of the respective front-most conveyed item 3 of the imbricated stream of conveyed items and to pull off in a clocked fashion the respective conveyed item in order to feed it to further handling or processing means. In the embodiment shown in FIG. 2, the removal device 30 can take the form of a conveying chain 31 which is activated in clocked fashion by a drive 32 as soon as gripper tongs 33 which are attached to the conveying chain 31 have taken hold of the front edge of a conveyed item 3. The upper claw of the gripper tongs 33 is prestressed against the lower gripper claw in the closed position by spring means, and as soon as the conveying chain 31 has moved the gripper tongs 33 into the pick-up position, it is opened by a cam of the upper gripper claw running up against a cam plate 34. The cam plate 34 can be lowered by means of a drive 35 in order to close the gripper tongs. Detectors, for example proximity detectors or photoelectric barriers (not shown in the drawing) signal the respective operating position of the conveying chain 31 and of the gripper tongs 33.

If the conveying chain 31 is in the operating position which is indicated in FIG. 2 and in which the gripper tongs 33 are opened and ready to pick up, a control signal, which is derived from the drive or a rotary sensor of said drive, of a control unit 36 outputs a request signal which, via a control line 37, causes the drive 16 to activate the conveyor belt units 10 and 13 and the circulating belt 19, and ultimately an imbricated stream of conveyed items emerges on the transfer table 12 on the delivery side of the conveyor belt units 10 and 13 in the manner described above.

As soon as the first conveyed item of this imbricated stream of conveyed items interrupts the photoelectric barrier forming a first detector 38, the output signal of this detector 38 causes the control unit 36 to change the drive 16 into a prepositioning mode, for which purpose, assuming a constant drive speed of the drive 16, timing means of the control unit 36 activate the drive 16 for a period which is sufficient to move the leading edge of the first conveyed item from the detector 38 as far as the gripper tongs 33.

A second detector 39 which follows the detector 38 in the conveying direction and which can in turn be formed by a photoelectric barrier which is mounted in the transfer table 12 then causes the drive 16 to be fine-controlled by the control unit 36 in such a way that the leading edge of the first conveyed item of the imbricated stream of conveyed items is moved in completely between the gripper claws of the gripper tongs 33, and the upper gripper claws of the gripper tongs 33 are then closed by the cam plate 34 being activated by means of the drive 35, after which the drive 32 is switched on and the conveying chain 31 draws off to the left the first conveyed item at its leading edge with respect to the position and setting of the components shown in FIG. 2.

The distance between the photoelectric barrier forming the detector 39 and the base of the gripper tongs 33 is selected such that, after the respective first conveyed item is pulled out of the imbricated stream of conveyed items, the photoelectric barrier or the detector 39 is enabled again and is available for the fine-positioning procedure of the, then, first further conveyed item. The aforesaid distance is therefore in all cases smaller than the minimum separation distance or imbrication distance between the conveyed items.

It is also to be noted that the distance between the gripper tongs 33 located in the pick-up position and the output side of the gap between the conveyor belt units 10 and 13 is selected such that a conveyed item which is held by its leading edge by the gripper tongs 33 is still held by its rear edge between the conveyor belt units 10 and 13. When the conveyor chain 31 is activated, this conveyed item which is grasped by the tongues 33 is then pulled between the conveyor belt units 10 and 13. In order to set the system to different formats of the conveyed items with respect to the conveying direction, as indicated in FIG. 1, the removal device 30 and the transfer table 12 are designed as one unit and can be moved and adjusted in the conveying direction on a trolley or carriage 40 so that the distance between the gripper tongs 33 located in the pick-up position and the output side of the conveyor belt units 10 and 13 can be changed in accordance with the format of the conveyed items. Furthermore it is to be noted that, in order to support the conveyor belts of the conveyor belt unit 13, the rollers are mounted on a common frame which can itself be pivoted about a horizontal axis parallel to the bearing axes of the rollers in such a way that the common conveyor belt unit 13 can be pivoted upwards for maintenance purposes or for dealing with faults in the conveyor belt unit 10. In order to simplify the representation in the drawing, the relevant designs here, which are known to the person skilled in the art, and also means for holding down the conveyed items in the region above the transfer table 12 are omitted.

Figure 4:
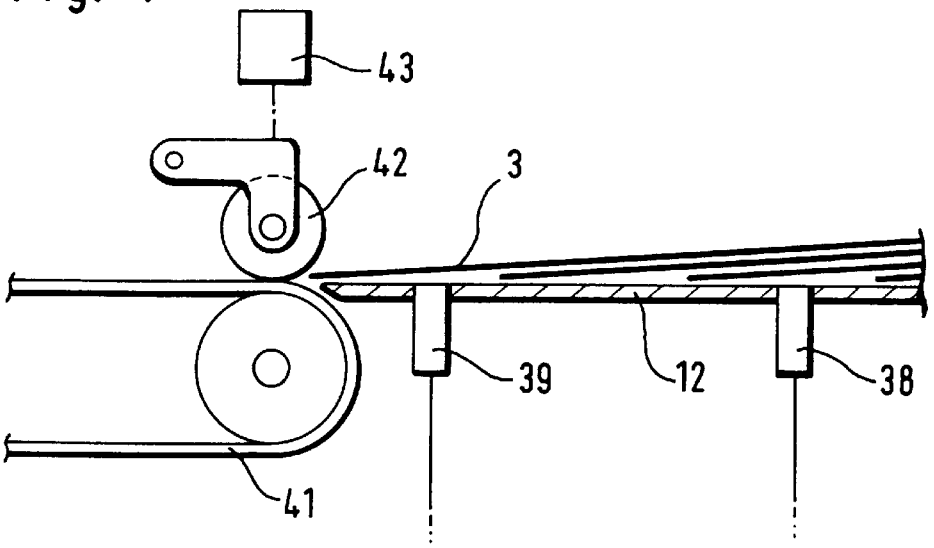
FIG. 4 shows a schematic side view, drawn partially in section, of a modified form of the removal device of a feeding machine according to FIG. 1.

According to the modified embodiment shown in FIG. 4, the removal device 30 can also contain pairs of removal conveyor belts or rollers 41 and 42 which face one another and which also form a conveyor gap, it being possible for the removal conveyor rollers 42 either to be raised into a position of rest, or lowered into a conveying position against the removal conveyor belts 41, by means of a drive 43. In this form of removal device 30, the conveyor belts 41 can circulate continuously. As soon as the leading edge of a conveyed item 3 has been moved between the removal conveyor belts 41 and the removal conveyor rollers 42 after the detector 39 has responded, the drive 43 presses the removal conveyor rollers downwards, as a result of which the front-most conveyed item 3 is moved out of the imbricated stream of conveyed items and is pulled out with its trailing edge between the conveyor belt units 10 and 13 and the processes explained in conjunction with FIGS. 1 and 2 are repeated.

The design of the imbricator strip 21 which is shown principally in FIG. 3 is independently significant in that, owing to the hard smooth surface of the circulating belt 19 interacting with the front strip 27 and the edge of the imbricator strip 26, a very precise setting of the imbrication event, and, to this extent, of the separation of items as they are conveyed by the conveyor belts 9 is given and also as a result of the circulating belt 19 being provided it is also possible to set the format by moving the carriage 23 in the guide rail 22. It may be expedient here to provide, underneath the upper strand 18 of the circulating belt 19, a retaining and supporting face of the upper strand 18, for example by means of part of the base 6 in that area of the upper strand 18 over which the imbricator strip 21 can be adjusted in the conveying direction of the belts 9 in order to adjust the format.

In terms of the control device 36, it is to be noted that by means of rotary sensor output signals of the drive 32 for the conveying chain 31 it is determined when, and over which periods or drive path sections, the drive 16 for the conveyor belt units 10 and 13 is activated. The detectors 38 and 39 determine, as a control means which are arranged downstream, the conveying of the imbricated stream of conveyed items into the gripper tongs 33 or into the conveyor gap between the conveyor belts 41 and the contact rollers 42 (FIG. 4).

However, in the description above, the imbrication or separation is also to be understood to mean a state of the conveyed items in which they no longer overlap one another but are instead conveyed onto the transfer table 12 in a completely separated state.

What is claimed is:

1. Feeding machine for feeding stacked, flat, flexible conveyed items into a station for further individual handling, the feeding machine comprising:

(a) a downwardly inclined feed channel for holding a stack of conveyed items, the feed channel having a lower end; the feed channel having a gradient and a length selected to be sufficiently large to allow large stacks of conveyed items in it to slip downwards by gravity, but the gradient also being small enough to limit the pressure of the stack on a bottommost item to be conveyed;

(b) an upwardly inclined discharge channel coupled to the lower end of the downwardly inclined feed channel, the discharge channel comprising a first conveyor belt unit for conveying the conveyed items in an downstream direction, upwardly from a bottom of the stack at the lower end of the feed channel;

(c) an imbricator strip positioned within the upwardly inclined discharge channel to imbricate the conveyed items in the discharge channel;

(d) a low friction circulating belt located opposite from the imbricating strip in the upwardly inclined discharge channel, the imbricating strip and the circulating belt forming a gap through which imbricated conveyed items are passed (e) a second conveyor belt unit downstream of the imbricator strip and positioned over the first conveyor belt unit to form a conveying path between the first and second conveyor belt units, the conveying path for receiving and transporting the imbricated conveyed items in the downstream direction, the conveying path changing from being initially upwardly inclined at an upstream end to substantially horizontal at a downstream discharge end;

(f) a detector arrangement positioned a predetermined distance downstream, from the discharge end of the conveying path, the detector arrangement detecting a leading edge of conveyed items discharged from the conveying path and providing a detector signal;

(g) a removal device positioned downstream of the discharge end of the conveying path, the removal device removing individual conveyed items at a predetermined regular time interval;

(h) a controller device coupled to the removal device and the first and second conveyor belt units, the controller device adjusting a transport speed of the first and second conveyor belt units responsive to the detector signal and the predetermined regular time interval, the controller device adjusting the transport speed of the first and second conveyor belt units to regulate a rate at which conveyed items are presented for removal by the removal device.

2. The feeding machine as recited in claim 1 wherein the feed channel and the discharge channel have an adjustable side wall to accommodate conveyed items of different sizes.

3. The feeding machine as recited in claim 1 wherein the imbricating strip can be adjustably positioned in an upstream or downstream direction.

4. The feeding machine as recited in claim 1 wherein the imbricating strip can be adjustably positioned to narrow or widen a gap between the imbricating strip and the discharge channel, whereby conveyed items pass through the gap.

5. The feeding machine as recited in claim 1 wherein the removal device comprises removal conveyor belts driven by the controller responsive to the detector signal.

6. The feeding machine as recited in claim 1 wherein the removal device comprises contact rollers driven by the controller responsive to the detector signal.

7. The feeding machine as recited in claim 1 wherein the removal device comprises a conveying chain fitted with gripper tongs for grasping individual conveyed items to be removed the regular predetermined time interval.

8. The feeding machine as recited in claim 1 wherein the detector arrangement comprises a first detector located just downstream of the discharge end of the conveying path, the first detector generating a first detector signal; and a second detector located upstream of the removal device at a distance shorter than a predetermined minimum distance between conveyed items, the second detector generating a second detector signal;

wherein, responsive to the first and second detector signals, the controller device adjusts the transport speed of the first and second conveyor units to preposition the conveyed items for removal by the removal device.

9. The feeding machine as recited in claim 8 wherein responsive to the second detector signal the controller device causes the first and second conveyor units to move a set predetermined distance to preposition the conveyed items for removal.

10. The feeding machine as recited in claim 1 wherein the removal device is located at a distance downstream of the conveying path discharge end by a distance that is less than an upstream-downstream length of the conveyed item.

11. The feeding machine as recited in claim 1 wherein a distance between the removal device and the conveying path discharge end is adjustable.

12. The feeding machine as recited in claim 1 wherein the feed channel is dimensioned to accept a stack of envelopes as the stack of flexible conveyed items.

* * * * *